US009843098B2

(12) United States Patent
Pruett et al.

(10) Patent No.: US 9,843,098 B2
(45) Date of Patent: Dec. 12, 2017

(54) INTERLEAVED ELECTRONICALLY SCANNED ARRAYS

(71) Applicant: RAYTHEON COMPANY, Waltham, MA (US)

(72) Inventors: James A. Pruett, McKinney, TX (US); Thomas T. Leise, McKinney, TX (US); Jerry M. Grimm, McKinney, TX (US)

(73) Assignee: Raytheon Company, Waltham, MA (US)

( * ) Notice: Subject to any disclaimer, the term of this patent is extended or adjusted under 35 U.S.C. 154(b) by 160 days.

(21) Appl. No.: 14/267,685

(22) Filed: May 1, 2014

(65) Prior Publication Data

US 2015/0318622 A1 Nov. 5, 2015

(51) Int. Cl.

| | |
|---|---|
| ***H01Q 21/00*** | (2006.01) |
| ***H01Q 5/42*** | (2015.01) |
| ***H01Q 21/30*** | (2006.01) |
| ***H01Q 21/24*** | (2006.01) |
| ***H01Q 21/06*** | (2006.01) |

(52) U.S. Cl.

CPC ..... *H01Q 5/42* (2015.01); *H01Q 21/0006* (2013.01); *H01Q 21/061* (2013.01); *H01Q 21/24* (2013.01); *H01Q 21/30* (2013.01)

(58) Field of Classification Search

CPC ..... H01Q 5/40; H01Q 3/46; H01Q 21/061; H01Q 21/062; H01Q 21/064; H01Q 21/065; H01Q 21/30; H01Q 21/0006; H01Q 21/24; H01Q 25/02; H01Q 25/04

USPC ..... 343/876, 893

See application file for complete search history.

(56) References Cited

U.S. PATENT DOCUMENTS

| | | | | |
|---|---|---|---|---|
| 6,020,853 | A * | 2/2000 | Richards | H01Q 1/38 343/700 MS |
| 6,114,998 | A * | 9/2000 | Schefte | H01Q 1/243 343/700 MS |
| 6,175,333 | B1 * | 1/2001 | Smith | H01Q 1/38 343/700 MS |
| 6,317,095 | B1 * | 11/2001 | Teshirogi | H01Q 3/24 343/770 |
| 6,433,754 | B1 * | 8/2002 | Boeringer | H01Q 21/061 343/893 |
| 6,529,166 | B2 * | 3/2003 | Kanamaluru | H01Q 25/00 343/700 MS |
| 6,795,020 | B2 * | 9/2004 | Sreenivas | H01Q 1/38 343/700 MS |
| 8,207,891 | B1 * | 6/2012 | Lam | H01Q 3/26 342/368 |
| 9,590,312 | B1 * | 3/2017 | Buckley | H01Q 13/106 |

(Continued)

FOREIGN PATENT DOCUMENTS

WO WO 03/083505 A1 10/2003

*Primary Examiner* — Dameon E Levi
*Assistant Examiner* — Ab Salam Alkassim, Jr.
(74) *Attorney, Agent, or Firm* — Lewis Roca Rothgerber Christie LLP

(57) ABSTRACT

An array antenna including two interleaved array antennas, capable of being operated independently at a first frequency, or together, at a second frequency. Each of the two array antennas is composed of alternating elements of an antenna array, and the two arrays are interleaved. Each of the interleaved arrays may be operated independently, e.g., in the X band, or the arrays may be driven together, as a single array with more densely spaced elements, e.g., in the Ku band.

17 Claims, 8 Drawing Sheets

(56) References Cited

U.S. PATENT DOCUMENTS

| | | | | |
|---|---|---|---|---|
| 2001/0052881 | A1* | 12/2001 | Rao | H01Q 25/04 343/786 |
| 2003/0076274 | A1* | 4/2003 | Phelan | H01Q 3/26 343/895 |
| 2005/0001784 | A1* | 1/2005 | Oliver | H01Q 3/26 343/895 |
| 2008/0129634 | A1* | 6/2008 | Pera | H01Q 9/0435 343/853 |
| 2008/0291818 | A1* | 11/2008 | Leisten | B29C 33/026 370/208 |
| 2010/0260076 | A1* | 10/2010 | Corman | H01Q 3/26 370/277 |
| 2012/0188117 | A1* | 7/2012 | Jeong | H01Q 3/24 342/175 |
| 2014/0218251 | A1* | 8/2014 | Waschenko | H01Q 13/10 343/770 |
| 2014/0375502 | A1* | 12/2014 | Foo | H01Q 9/0414 342/371 |
| 2015/0097747 | A1* | 4/2015 | Hwang | H01P 1/161 343/785 |

* cited by examiner

INTERLEAVED ELECTRONICALLY SCANNED ARRAYS

BACKGROUND

1. Field

One or more aspects of embodiments according to the present invention relate to electronically scanned array antennas, and more particularly to an antenna capable of operating with multiple beams, and at multiple frequencies.

2. Description of Related Art

Electronically scanned array (ESA) antennas have multiple applications, including radar applications. In such applications, it may be desirable to transmit or receive more than one beam at a time, at more than one frequency, or with more than one polarization state. For example, it may be desirable for a system to be capable of operating both in the X band (8 GHz to 12 GHz) and in the Ku band (12 GHz to 18 GHz). While this can be accomplished using multiple separate antennas, the size, weight, and power (SWaP) of an assembly with multiple array antennas may be difficult to accommodate, e.g., on an aircraft.

One approach to achieving dual bands, or wideband ESAs, is to design the element spacing for the highest frequency band and let the lower frequency band also use the same element spacing. The problem with this approach is that the element spacing is not optimized for the lower frequency band SWaP. Another approach is to modulate each desired signal independently to achieve multiple independently modulated beams. This is not practical at X band and higher, however.

Thus, there is a need for a low-SWaP antenna system capable of transmitting and receiving more than one beam at a time, at more than one frequency, or with more than one polarization state.

SUMMARY

Aspects of embodiments of the present disclosure are directed toward an array antenna including two or more interleaved array antennas, capable of being operated independently at a first frequency, or together, at a second frequency. Each of the array antennas is composed of alternating elements of an antenna array, and the arrays are interleaved. Each of the interleaved arrays may be operated independently, e.g., in either or both of the X band arrays, or the arrays may be driven together, as a single array with more densely spaced elements, e.g., in the Ku band.

According to an embodiment of the present invention there is provided an array antenna, including: a first plurality of antenna elements arranged in a first square pattern having a first grid spacing; a second plurality of antenna elements arranged in a second square pattern having a second grid spacing, the second grid spacing being the same as the first grid spacing, the antenna elements of the second plurality of antenna elements being interleaved with the antenna elements of the first plurality of antenna elements; a third plurality of antenna elements including the first plurality of antenna elements and the second plurality of antenna elements, the third plurality of antenna elements arranged in a third square pattern having a third grid spacing, the third square pattern being oriented at 45 degrees relative to the first square pattern and to the second square pattern, the third grid spacing being less than the first grid spacing by a factor of the square root of 2; a first feed network configured for transmitting and receiving signals through the first plurality of antenna elements; a second feed network configured for transmitting and receiving signals through the second plurality of antenna elements; and a third feed network configured for transmitting and receiving signals through the third plurality of antenna elements.

In one embodiment, each of the third plurality of antenna elements includes a notch radiator.

In one embodiment, each of the third plurality of antenna elements includes a flared notch radiator.

In one embodiment, each of the third plurality of antenna elements includes a stepped notch radiator.

In one embodiment, each of the third plurality of antenna elements includes a stacked patch radiator.

In one embodiment, each of the third plurality of antenna elements includes a dielectric material with a dielectric constant greater than 3.

In one embodiment, the first grid spacing is substantially equal to 0.484 inches.

In one embodiment, the first feed network is configured to operate at a frequency in the X band.

In one embodiment, the second feed network is configured to operate at a frequency in the X band.

In one embodiment, the third feed network is configured to operate at a frequency in the Ku band.

In one embodiment, the third feed network includes the first feed network and the second feed network, and wherein the first feed network, the second feed network, and the third feed network are configured to operate over a range of frequencies extending from a frequency in the X band to a frequency in the Ku band.

In one embodiment, the range of frequencies includes a first frequency and a second frequency, the second frequency being greater than the first frequency by a factor of the square root of 2.

In one embodiment, the first plurality of antenna elements is configured to radiate or receive a first polarization state, and the second plurality of antenna elements is configured to radiate or receive a second polarization state, the second polarization state being substantially different from the first polarization state.

In one embodiment, the first plurality of antenna elements is configured to radiate or receive a first polarization state, and the second plurality of antenna elements is configured to radiate or receive a second polarization state, the second polarization state being substantially orthogonal to the first polarization state.

In one embodiment, the first plurality of antenna elements is configured to radiate or receive a first polarization state, and the second plurality of antenna elements is configured to radiate or receive a second polarization state, the first polarization state being circular polarization with a first chirality, the second polarization state being circular polarization with a second chirality, and the first chirality being different from the second chirality.

In one embodiment, each of the antenna elements of the first plurality of antenna elements, and of the second plurality of antenna elements includes a transmit-receive module.

In one embodiment, each of the antenna elements of the first plurality of antenna elements and of the second plurality of antenna elements includes: a first transmit-receive module; a second transmit-receive module; and a plurality of switches, configured to connect the antenna element either to the first transmit-receive module or to the second transmit-receive module.

In one embodiment, the plurality of switches includes a p-type/intrinsic/n-type diode (PIN diode) switch.

In one embodiment, the array includes: a first plurality of switches configured to selectively connect the first plurality of antenna elements either to the first feed network or to the third feed network; and a second plurality of switches configured to selectively connect the second plurality of antenna elements either to the second feed network or to the third feed network.

In one embodiment, the first plurality of switches includes a p-type/intrinsic/n-type diode (PIN diode) switch; and the second plurality of switches includes a p-type/intrinsic/n-type diode (PIN diode) switch.

BRIEF DESCRIPTION OF THE DRAWINGS

Features, aspects, and embodiments are described in conjunction with the attached drawings, in which.

DETAILED DESCRIPTION

The detailed description set forth below in connection with the appended drawings is intended as a description of exemplary embodiments of interleaved electronically scanned arrays provided in accordance with the present invention and is not intended to represent the only forms in which the present invention may be constructed or utilized. The description sets forth the features of the present invention in connection with the illustrated embodiments. It is to be understood, however, that the same or equivalent functions and structures may be accomplished by different embodiments that are also intended to be encompassed within the spirit and scope of the invention. As denoted elsewhere herein, like element numbers are intended to indicate like elements or features.

Figure 1:
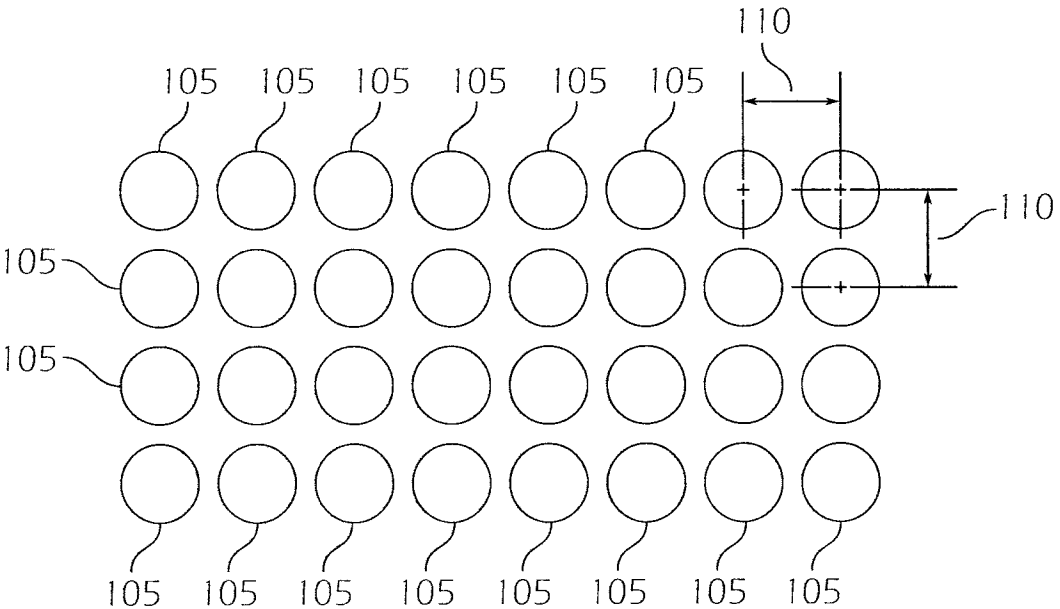
FIG. 1 is a schematic diagram of a layout of antenna elements in an array according to an embodiment of the present invention.

Referring to FIG. 1, in one embodiment an array of antenna elements 105 is arranged on a square pattern, with the antenna elements 105 arranged in rows, and in columns perpendicular to the rows, the spacing between adjacent antenna elements 105 in each row, referred to herein as the fine grid spacing 110, being substantially the same as the spacing between adjacent antenna elements 105 in each column. The grid spacing 110 does not have to be exactly the same in the vertical and horizontal directions. Also the array of antenna elements 105 are shown in a square pattern, but they could be offset from a square pattern to create a triangular pattern. The antenna elements 105 are illustrated schematically as circles in FIG. 1, but the invention is not limited to circular structures. Antenna elements 105 may be formed as any type of radiating element that will fit in the fine grid spacing, such as a flared notch radiator, a stepped notch radiator, or a stacked patch radiator. Moreover, the square pattern of FIG. 1 is illustrated as extending over a rectangular region with a size of 4 elements by 8 elements, but the invention is not limited to rectangular regions. In other embodiments a larger or smaller rectangular or square region, or a region of essentially arbitrary shape may be tiled with antenna elements 105 on the square pattern illustrated in FIG. 1 or in a triangular pattern.

Figure 2:
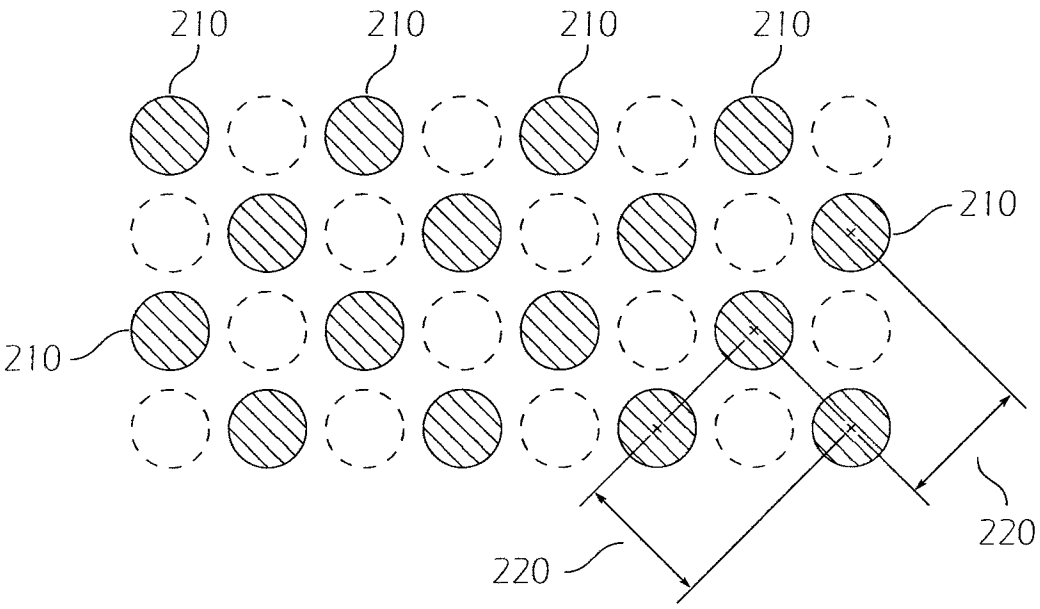
FIG. 2 is a schematic diagram of a layout of antenna elements in an array according to an embodiment of the present invention.

Referring to FIG. 2, in one mode of operation, a set of antenna elements 210 forms a subset of the set of antenna elements 105. This subset, referred to herein as the X1 pattern, is composed of every other antenna element in the square pattern, with the antenna elements 210 included in the X1 pattern in any row being offset by one column from the antenna elements 210 included in the X1 pattern in the row immediately above or below. The X1 pattern forms a square pattern of antenna elements 210, which is a pattern rotated 45 degrees with respect to the square pattern composed of all antenna elements 105, i.e., each row of the X1 pattern is oriented at 45 degrees to any row or column of the square pattern composed of all antenna elements 105, and each column of the X1 pattern is also oriented at 45 degrees to any row or column of the square pattern composed of all antenna elements 105. The X1 pattern is composed of antenna elements 210 on a larger grid spacing, referred to herein as the coarse grid spacing 220. In one embodiment the coarse grid spacing 220 is selected to be suitable for transmitting or receiving X-band radiation, with, e.g., a coarse grid spacing 220 substantially equal to 0.484 inches.

Figure 3:
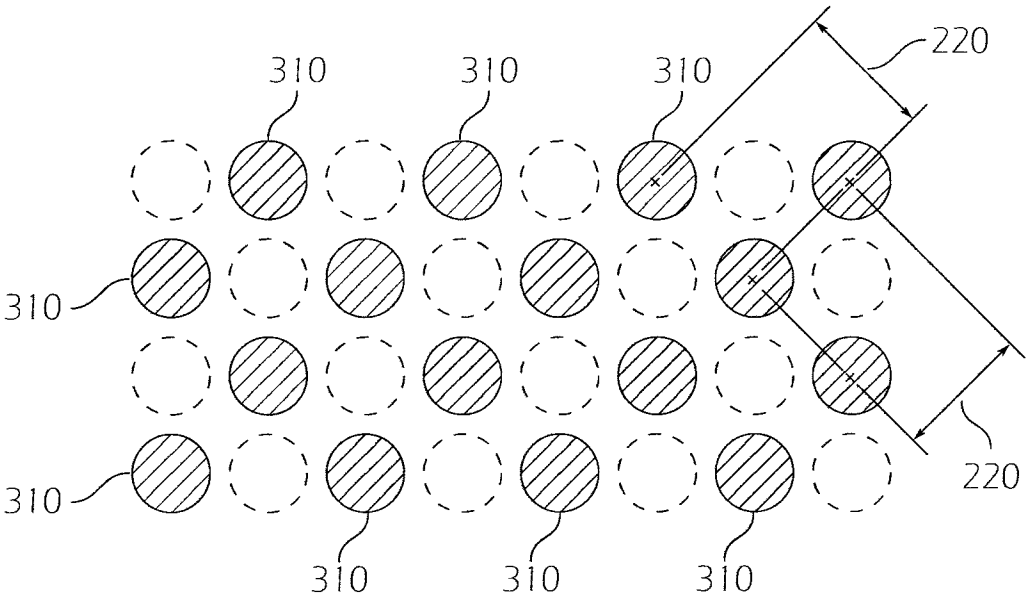
FIG. 3 is a schematic diagram of a layout of antenna elements in an array according to an embodiment of the present invention.

Referring to FIG. 3, in another mode of operation, a second set of antenna elements 310 forms another subset of the antenna elements 105. This subset, referred to herein as the X2 pattern, is also composed of every other antenna element in the square pattern, with the antenna elements 310 included in the X2 pattern in any row being offset by one column from the antenna elements 310 included in the X2 pattern in the row immediately above or below. The antenna elements 310 included in the X2 pattern are offset by a distance of one fine grid spacing from the antenna elements 210 included in the X1 pattern. In this manner, the antenna elements 310 included in the X2 pattern are interleaved with the antenna elements 210 included in the X1 pattern. The X2 pattern, like the X1 pattern, forms a square pattern of antenna elements 310, which is a pattern rotated 45 degrees with respect to the square pattern composed of all antenna elements 105. The X2 pattern, like the X1 pattern, is a square pattern composed of antenna elements 310 on the coarse grid spacing 220.

In one embodiment the antenna elements 210 included in the X1 pattern and the antenna elements 310 included in the X2 pattern are sufficiently small to fit into an interleaved pattern. This may be accomplished by constructing the antenna elements 105 with a suitable dielectric, having a sufficiently high dielectric constant to allow for effective operation of a device with small dimensions. Such a dielectric may be a ceramic material or another material loaded with a ceramic material. In one embodiment a dielectric material with a dielectric constant of 3.4 or greater, such as DUROID™ 6006 or DUROID™ 6010, available from Rogers Corporation of Rogers, Conn., with dielectric constants of 6.45 and 10.7 respectively, may be used. The antenna elements 210, 310 may be fabricated on printed wiring boards (PWBs), e.g., using stripline structures. In one embodiment, the antenna elements have effective operation in both bands of interest.

Figure 4:
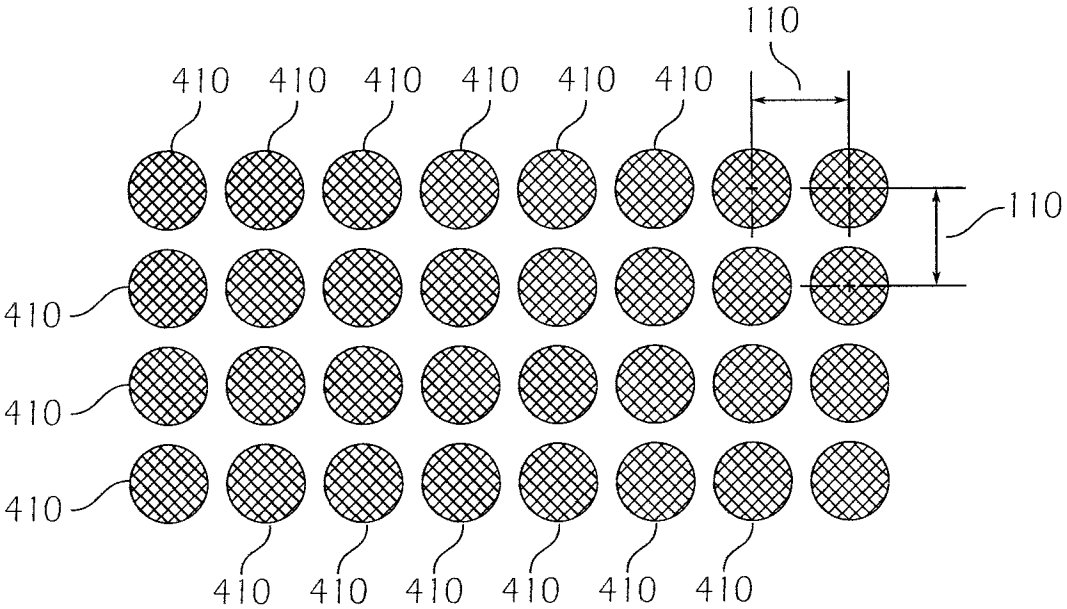
FIG. 4 is a schematic diagram of a layout of antenna elements in an array according to an embodiment of the present invention.

Referring to FIG. 4, in a third mode of operation, a third set of antenna elements 410 forms a subset of the antenna elements 105. This subset, referred to herein as the Ku pattern, is composed of adjacent antenna elements in the square pattern. The Ku pattern may include all of the antenna elements 105. The grid spacing of the square pattern of the Ku pattern is the fine grid spacing 110. The fine grid spacing 110 and the coarse grid spacing 220 are related by the geometry of the square pattern to be in the ratio of one to the square root of 2, i.e., a ratio of approximately 1:1.4142. In an embodiment in which the coarse grid spacing 220 is substantially equal to 0.484 inches, the fine grid spacing is substantially equal to 0.342 inches, and may be suitable for transmitting or receiving radiation in the Ku band.

Figure 5:
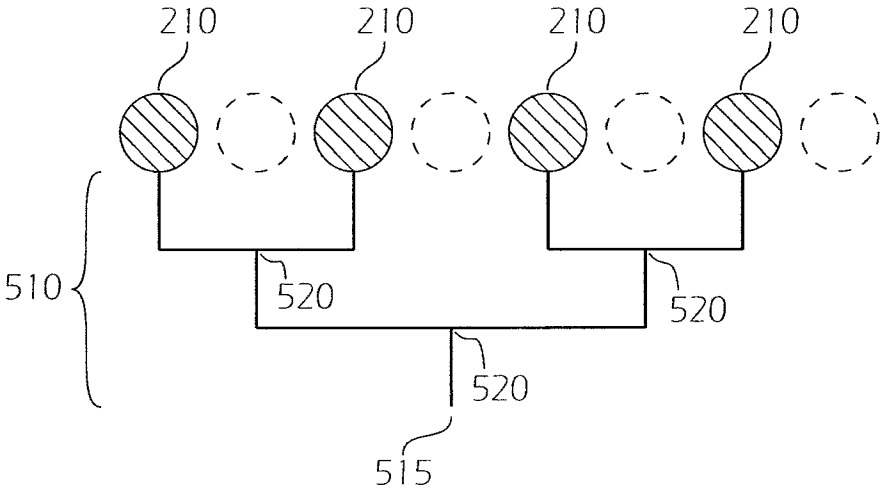
FIG. 5 is a schematic diagram of a layout of antenna elements in an array connected to a first feed network according to an embodiment of the present invention.

Referring to FIG. 5, in one embodiment, the antenna elements 210 of the X1 pattern are connected to a first feed network 510, which is used, when the array of antenna elements 210 is transmitting, to conduct a signal to be transmitted by the antenna elements 210 from a first common connection 515 to all of the antenna elements 210 of the X1 pattern. The first feed network 510 may include one or more power dividers 520, each one of which may split the power from one input to two or more outputs. The power dividers 520 may, for example, be Wilkinson power dividers. The first feed network 510 may also serve the purpose, when the array of antenna elements 210 is receiving, of combining signals received at the antenna elements 210 of the X1 pattern and conducting these signals to the first common connection 515. Each of the power dividers 520 may participate in both functions, that of splitting the transmitted signal from the first common connection 515 and delivering it to the antenna elements 210, and that of combining the signal received at the antenna elements 210 and delivering it to the first common connection 515. Wilkinson power dividers, for example, are suitable for such dual-purpose use, as both power dividers and power combiners. For clarity, only 4 of the elements of the X1 pattern are shown in FIG. 5. The first feed network 510, however, may be connected to all of the antenna elements 210, to transmit signals through, or receive signals from, all of them.

Figure 6:
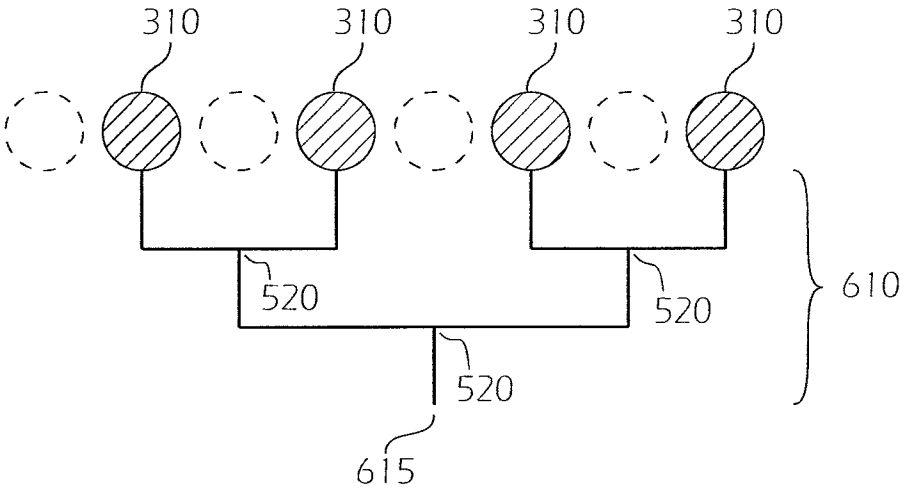
FIG. 6 is a schematic diagram of a layout of antenna elements in an array connected to a second feed network according to an embodiment of the present invention.

Referring to FIG. 6, in one embodiment, the antenna elements 310 of the X2 pattern are connected to a second feed network 610, which is used, when the array of antenna elements 210 is transmitting, to conduct a signal to be transmitted by the antenna elements 310 from a second common connection 615 to all of the antenna elements 310 of the X2 pattern. As is the case with the first feed network 510, the second feed network 610 may include one or more power dividers 520, each one of which may split the power from one input to two or more outputs. The second feed network 610 may also serve the purpose, when the array of antenna elements 210 is receiving, of combining signals received at the antenna elements 310 of the X2 pattern and conducting these signals' to the second common connection 615. Each of the power dividers 520 may participate in both functions, that of splitting the transmitted signal from the second common connection 615 and delivering it to the antenna elements 310, and that of combining the signal received at the antenna elements 310 and delivering it to the second common connection 615. For clarity, only 4 of the elements of the X2 pattern are shown in FIG. 6. The second feed network 610 may however be connected to all of the antenna elements 310, to transmit signals through, or receive signals from, all of them.

Figure 7:
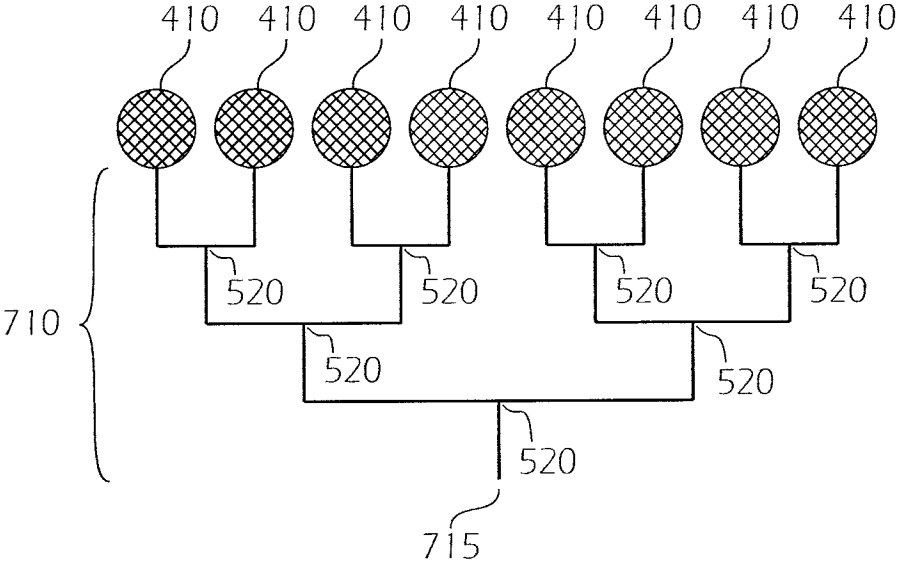
FIG. 7 is a schematic diagram of a layout of antenna elements in an array connected to a third feed network according to an embodiment of the present invention.

Referring to FIG. 7, in one embodiment, the antenna elements 410 of the Ku pattern are connected to a third feed network 710, which is used, when the array of antenna elements 210 is transmitting, to conduct a signal to be transmitted by the antenna elements 410 from a second common connection 715 to all of the antenna elements 410 of the Ku pattern. As is the case with the first feed network 510 and the second feed network 610, the third feed network 710 may include one or more power dividers 520, each one of which may split the power from one input to two or more outputs. The third feed network 710 may also serve the purpose, when the array of antenna elements 210 is receiving, of combining signals received at the antenna elements 410 of the Ku pattern and conducting these signals to the second common connection 715. Each of the power dividers 520 may participate in both functions, that of splitting the transmitted signal from the second common connection 715 and delivering it to the antenna elements 410, and that of combining the signal received at the antenna elements 410 and delivering it to the second common connection 715. For clarity, only 8 of the elements of the Ku pattern are shown in FIG. 7. The third feed network 710 may, however, be connected to all of the antenna elements 410, to transmit signals through, or receive signals from, all of them.

Figure 8:
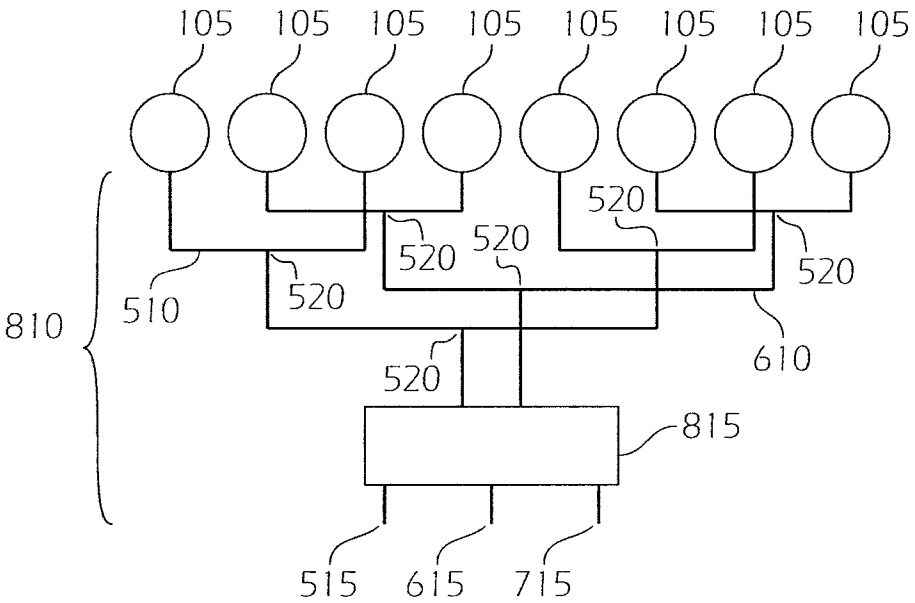
FIG. 8 is a schematic diagram of a layout of antenna elements in an array connected to a composite feed network according to an embodiment of the present invention.

Referring to FIG. 8, in one embodiment, a single composite feed network 810 provides a first feed network to feed the antenna elements 210 included in the X1 pattern, a second feed network to feed the antenna elements 310 included in the X2 pattern, and a third feed network to feed the antenna elements 410 included in the Ku pattern. The composite feed network 810 includes a switch matrix 815, for connecting the common connections 515, 615, and 715 to the first feed network 510, the second feed network 610, or both, respectively. In particular, the switch matrix 815 may contain switches for connecting the first common connection 515 to the first feed network 510, for connecting the second common connection 615 to the second feed network 610, and for connecting a power divider between the third common connection 715 and first and second common connections 515 and 615. External circuitry, e.g., radar circuitry, may be connected to the common connections 515, 615, and 715. In this embodiment, depending on the state of the switches in the switch matrix 815, the antenna elements 210 included in the X1 pattern may be activated, i.e., connected to the external circuitry, or the antenna elements 310 included in the X2 pattern may be activated, or both may be activated simultaneously, or the antenna elements 410 included in the Ku pattern may be activated.

In other embodiments, the switch matrix 815 may contain, or may be replaced by a circuit containing, additional power dividers or power combiners allowing the common connections 515, 615, 715 to be connected simultaneously to the antenna elements 105. Each antenna element 105 may include a configuration of conductors and dielectric components for coupling conducted waves to electromagnetic radiation propagating in free space. Each antenna element 105 may be passive or it may be active, including for example a transmit-receive module (T/R module) with a power amplifier for transmitting and a low-noise amplifier for receiving.

In the embodiment of FIG. 8, the first feed network 510 and the second feed network 610 are both constructed to have sufficient bandwidth to operate with acceptable performance at the frequency at which the antenna elements 210 included in the X1 pattern operate effectively as an array (which may be a frequency in the X band), at the frequency at which the antenna elements 310 included in the X2 pattern operate effectively as an array (which may also be a frequency in the X band), and also at the frequency at which the antenna elements 410 included in the Ku pattern operate effectively as an array (which may be a frequency in the Ku band).

A feed network designed to operate over a broad range of frequencies or at two widely separated frequencies (e.g., using Wilkinson power dividers with intermediate path lengths) may have reduced performance compared to a feed network designed for a single frequency. In one embodiment of the present invention, three independent feed networks are provided, each designed for a narrow operating frequency range, e.g., X band or Ku band, and switches are used to connect, at any given time, the feed networks to respective subsets, 210, 310, or 410, of the set of antenna elements 105, so that the array antenna operates, with high performance, at one frequency at a time. In another embodiment, a monolithic microwave integrated circuit (MMIC) at each antenna element 105 may be used to control the gain and phase (e.g., using a shifter chain) of the transmitted and received signals. A MMIC capable of operating at two operating frequencies may be used, or the MMIC may contain switches for routing the transmit and receive signals through one of two paths, e.g., two shifter chains, each of which may be optimized for one frequency. In this embodiment the antenna may operate at only one frequency at a time, and the switching may be used to reconfigure the antenna for the frequency in use at any time. In another embodiment the system may contain two MMICs at each antenna element, one for each operating frequency, and switches to route the signal to one MMIC or the other, again controlled so as to reconfigure the antenna for the frequency in use at any time.

The switches may be p-type/intrinsic/n-type diodes (PIN diodes). Each of the feed networks 510, 610, 710 may be a corporate feed as illustrated in FIGS. 5, 6, and 7 or it may be another configuration, such as a series feed configuration. In some embodiments, an array antenna built according to the present invention may have twice as many T/R modules, and require twice as much power, and twice as much cooling, as a conventional X-band antenna with the same number of elements as the X1 pattern or the X2 pattern, and the X1 pattern and the X2 pattern may have reversed polarities.

Embodiments of the present invention have applications in various systems employing array antennas, including radar. In a radar system, for example, it may be advantageous to operate two independent X-band antennas to provide two independently steerable radar beams, for simultaneously tracking two different objects, and a Ku-band antenna may be operated simultaneously to provide better radar resolution in a third beam. The X-band antennas may be operated at the same frequency, or at different frequencies within the X band. The X-band beams may not achieve the resolution of a Ku-band beam, but they may achieve greater range. In other embodiments it may be advantageous to configure the antenna elements 210 included in the X1 pattern to operate in a first polarization state and the antenna elements 310 included in the X2 pattern to operate in a second polarization state, so that, e.g., a radar target which alters the polarization state of electromagnetic waves upon reflection may be illuminated by a beam transmitted by the antenna elements 210 and may produce radar returns efficiently received by the antenna elements 310. The first and second polarization states may differ substantially, e.g., they may be orthogonal, such as two orthogonal linear polarizations, or two circular polarizations of different chirality, one being right circularly polarized and the other being left circularly polarized.

Although limited embodiments of interleaved electronically scanned arrays have been specifically described and illustrated herein, many modifications and variations will be apparent to those skilled in the art. Accordingly, it is to be understood that interleaved electronically scanned arrays employed according to principles of this invention may be embodied other than as specifically described herein. The invention is also defined in the following claims, and equivalents thereof.

What is claimed is:

1. An array antenna, comprising:

a first plurality of antenna elements arranged in a first square pattern having a first grid spacing;

a second plurality of antenna elements arranged in a second square pattern having a second grid spacing, the second grid spacing being the same as the first grid spacing, the antenna elements of the second plurality of antenna elements being interleaved with the antenna elements of the first plurality of antenna elements;

a third plurality of antenna elements comprising the first plurality of antenna elements and the second plurality of antenna elements, the third plurality of antenna elements arranged in a third square pattern having a third grid spacing, the third square pattern being oriented at 45 degrees relative to the first square pattern and to the second square pattern, the third grid spacing being less than the first grid spacing by a factor of the square root of 2;

a first feed network configured for transmitting and receiving signals through the first plurality of antenna elements;

a second feed network configured for transmitting and receiving signals through the second plurality of antenna elements; and a third feed network configured for transmitting and receiving signals through the third plurality of antenna elements wherein:

none of the antenna elements of the first plurality of antenna elements is an antenna element of the second plurality of antenna elements, the first feed network is configured to operate at a frequency in the X band, the second feed network is configured to operate at a frequency in the X band, the third feed network is configured to operate at a frequency in the Ku band, and each of the antenna elements, of the first plurality of antenna elements, the second plurality of antenna elements, and the third plurality of antenna elements, is configured to operate at a frequency in the X band and at a frequency in the Ku band.

2. The array antenna of claim 1, wherein each of the third plurality of antenna elements comprises a notch radiator.

3. The array antenna of claim 2, wherein each of the third plurality of antenna elements comprises a flared notch radiator.

4. The array antenna of claim 2, wherein each of the third plurality of antenna elements comprises a stepped notch radiator.

5. The array antenna of claim 1, wherein each of the third plurality of antenna elements comprises a stacked patch radiator.

6. The array antenna of claim 1, wherein each of the third plurality of antenna elements comprises a dielectric material with a dielectric constant greater than 3.

7. The array antenna of claim 1, wherein the first grid spacing is substantially equal to 0.484 inches.

8. The array antenna of claim 1, wherein the third feed network comprises the first feed network and the second feed network, and wherein the first feed network, the second feed network, and the third feed network are configured to operate over a range of frequencies extending from a frequency in the X band to a frequency in the Ku band.

9. The array antenna of claim 8, wherein the range of frequencies includes a first frequency and a second frequency, the second frequency being greater than the first frequency by a factor of the square root of 2.

10. The array antenna of claim 1, wherein the first plurality of antenna elements is configured to radiate or receive a first polarization state, and the second plurality of antenna elements is configured to radiate or receive a second polarization state, the second polarization state being substantially different from the first polarization state.

11. The array antenna of claim 10, wherein the first plurality of antenna elements is configured to radiate or receive a first polarization state, and the second plurality of antenna elements is configured to radiate or receive a second polarization state, the second polarization state being substantially orthogonal to the first polarization state.

12. The array antenna of claim 11, wherein the first plurality of antenna elements is configured to radiate or receive a first polarization state, and the second plurality of antenna elements is configured to radiate or receive a second polarization state, the first polarization state being circular polarization with a first chirality, the second polarization state being circular polarization with a second chirality, and the first chirality being different from the second chirality.

13. The array antenna of claim 1, wherein each of the antenna elements of the first plurality of antenna elements, and of the second plurality of antenna elements comprises a transmit-receive module.

14. The array antenna of claim 1, wherein each of the antenna elements of the first plurality of antenna elements and of the second plurality of antenna elements comprises:

a first transmit-receive module;

a second transmit-receive module; and a plurality of switches, configured to connect the antenna element either to the first transmit-receive module or to the second transmit-receive module.

15. The array antenna of claim 14, wherein the plurality of switches comprises a p-type/intrinsic/n-type diode (PIN diode) switch.

16. The array antenna of claim 1, comprising:

a first plurality of switches configured to selectively connect the first plurality of antenna elements either to the first feed network or to the third feed network; and a second plurality of switches configured to selectively connect the second plurality of antenna elements either to the second feed network or to the third feed network.

17. The array antenna of claim 16, wherein:

the first plurality of switches comprises a p-type/intrinsic/n-type diode (PIN diode) switch; and the second plurality of switches comprises a p-type/intrinsic/n-type diode (PIN diode) switch.

* * * * *